US005458557A

United States Patent [19]

Bladie et al.

[11] Patent Number: 5,458,557

[45] Date of Patent: Oct. 17, 1995

[54] QUARTER FOLD FOLDING DEVICE HAVING A BALANCING SYSTEM

[75] Inventors: Gérard Bladie, Cires-Les-Mello; Eddie Smelten, Laigneville, both of France

[73] Assignee: Heidelberger Druckmaschinen AG, Heidelberg, Germany

[21] Appl. No.: 143,009

[22] Filed: Oct. 25, 1993

[30] Foreign Application Priority Data

Oct. 26, 1992 [FR] France ..... 92 12708

[51] Int. Cl.[6] ..... B65H 45/18

[52] U.S. Cl. ..... 493/444; 493/437; 74/52

[58] Field of Search ..... 493/422, 437, 493/468, 476, 444, 445; 83/629, 630; 74/44, 52, 590, 603; 270/45

[56] References Cited

U.S. PATENT DOCUMENTS

| | | | |
|---|---|---|---|
| 4,509,939 | 4/1985 | Müller | 493/444 |
| 4,715,240 | 12/1987 | Erich | 74/52 |
| 5,085,625 | 2/1992 | Kojima | 493/437 |
| 5,171,204 | 12/1992 | Müller | 493/444 |
| 5,267,935 | 12/1993 | Bialek et al. | 493/444 |

FOREIGN PATENT DOCUMENTS

| | | | |
|---|---|---|---|
| 0021260 | 1/1989 | Japan | 74/603 |
| 2263328 | 7/1993 | United Kingdom | 74/603 |

*Primary Examiner*—Bruce M. Kisliuk
*Assistant Examiner*—Christopher W. Day
*Attorney, Agent, or Firm*—Kenyon & Kenyon

[57] ABSTRACT

A quarter fold folding device is described, having a quarter fold blade suspended by two opposite ends from two pivots, which are free to rotate with respect to the blade and are securely fastened to two connecting rods at one of their ends. The connecting rods are, at their opposite ends, rotationally driven in opposite directions, respectively, by means of two horizontal shafts rotating about their longitudinal axis. The rotating shafts are simultaneously rotationally driven in opposite directions respectively about two horizontal and parallel central axes, so that when the two rotating shafts perform a complete revolution about the parallel central axes, the two opposite ends of the folding blade driven by the connecting rods describe two parallel vertical segments of a straight line between a bottom position and a top position of the quarter fold blade. The quarter fold blade in the bottom position engages a signature between two folding cylinders, so as to form a longitudinal fold in the signature. The quarter fold folding device also includes a system for balancing the dynamic forces generated by the moving quarter fold blade. This balancing system also includes two counter weights, rotationally mounted respectively on the shafts for rotationally driving the two connecting rods, so that the fly weights follow the opposing rotational movements of the connecting rods.

7 Claims, 5 Drawing Sheets

QUARTER FOLD FOLDING DEVICE HAVING A BALANCING SYSTEM

FIELD OF THE INVENTION

The present invention relates to the field of rotary printing presses and, in particular, to a folding machine for forming an additional fold in a signature.

BACKGROUND OF THE INVENTION

U.S. Pat. No. 4,509,939 discloses a quarter fold folding device having a quarter fold blade arranged parallel to the direction of forward travel of a signature and intended to introduce the signature between two rotating cylinders parallel to the direction of forward travel, so as to form the longitudinal fold in the signature. The quarter fold blade is suspended from two drive cranks which are rotationally driven parallel in the same direction and at the same speed by means of two additional rotating cranks, each of which is connected to one end of the drive cranks by means of a rotating pivot. In particular, the two additional cranks rotationally driven in the same direction respectively about two first parallel axes, themselves rotationally drive, in the same direction, the drive cranks about the two parallel rotating pivots situated at the outer ends of the two additional cranks. When the additional cranks revolve about the first axes of rotation, the pivots, which are securely fastened, describe, in parallel, circles about these axes. Thus, during their movement, the drive cranks revolve around the pivots and simultaneously describe a circle about the first parallel axes of rotation of the additional cranks. In this manner, the drive cranks carrying the quarter fold blade drive the quarter fold blade in a vertical movement between a bottom position and a top position. Furthermore, U.S. Pat. No. 4,509,939 includes two balancing counterweights rotationally mounted on the rotating pivots, so that when the drive cranks describe the circle about the parallel axes of rotation of the additional cranks by simultaneously revolving about the pivots, the balancing counterweights revolve in the same direction about the pivots and also describe a circle in the same direction about the parallel axes.

A major drawback of such a device is that the balancing counterweights, which are intended to balance the forces generated in a vertical direction by the vertically moving quarter fold blade, themselves generate, in their circular movement, forces in a direction perpendicular to the direction of displacement of the blade, which make the entire device vibrate.

OBJECTS AND SUMMARY OF THE INVENTION

In order to overcome this drawback, the invention proposes a quarter fold folding device having a quarter fold blade disposed parallel to the direction of forward travel of the signature and above the signature. The quarter fold blade is coupled to a plurality of pivots, which are free to rotate with respect to the blade. A plurality of connecting rods, each having a first and a second end, are coupled at each first end to a respective pivot. Each of a plurality of horizontal and parallel shafts for rotationally driving the connecting rods is coupled to the second end of a respective connecting rod. The shafts are rotationally driven in opposing directions respectively about horizontal central axes. The rotating shafts are simultaneously rotationally driven in opposite directions, respectively, about the horizontal central axes, so that when the rotating shafts perform a complete revolution about the central axes, the folding blade is driven between a first position and a second position, the folding blade in the second position engaging the signature in the folding means.

The quarter fold folding device may further include a system for balancing the dynamic forces generated by the moving quarter fold blade. This balancing system has a plurality of counter weights rotatably coupled respectively to the shafts for counterbalancing the folding blade by revolving in opposing trajectories about the axes of rotation of the shafts and in opposing trajectories about the horizontal central axes.

Thus, the device according to the present invention makes it possible to drive the quarter fold blade in a vertical movement between a bottom position and a top position, and to counteract the vertical dynamic forces generated by the moving quarter fold blade. Furthermore, the counter weights, in their rotational movement about the rotating shafts of the connecting rods and simultaneously in their rotational movement about the central axes, generate horizontal forces which counteract one another because the counter weights revolve in opposing directions. The moving device according to the present invention is hence a balanced device.

The description which will follow with regard to the appended drawings, given by way of non-limiting examples, will describe the present invention and how it can be produced.

BRIEF DESCRIPTION OF THE DRAWINGS

FIG. 5 is a front view of the quarter fold folding device of FIG. 3, the quarter fold blade being in a top position.

DETAILED DESCRIPTION

Figure 1:
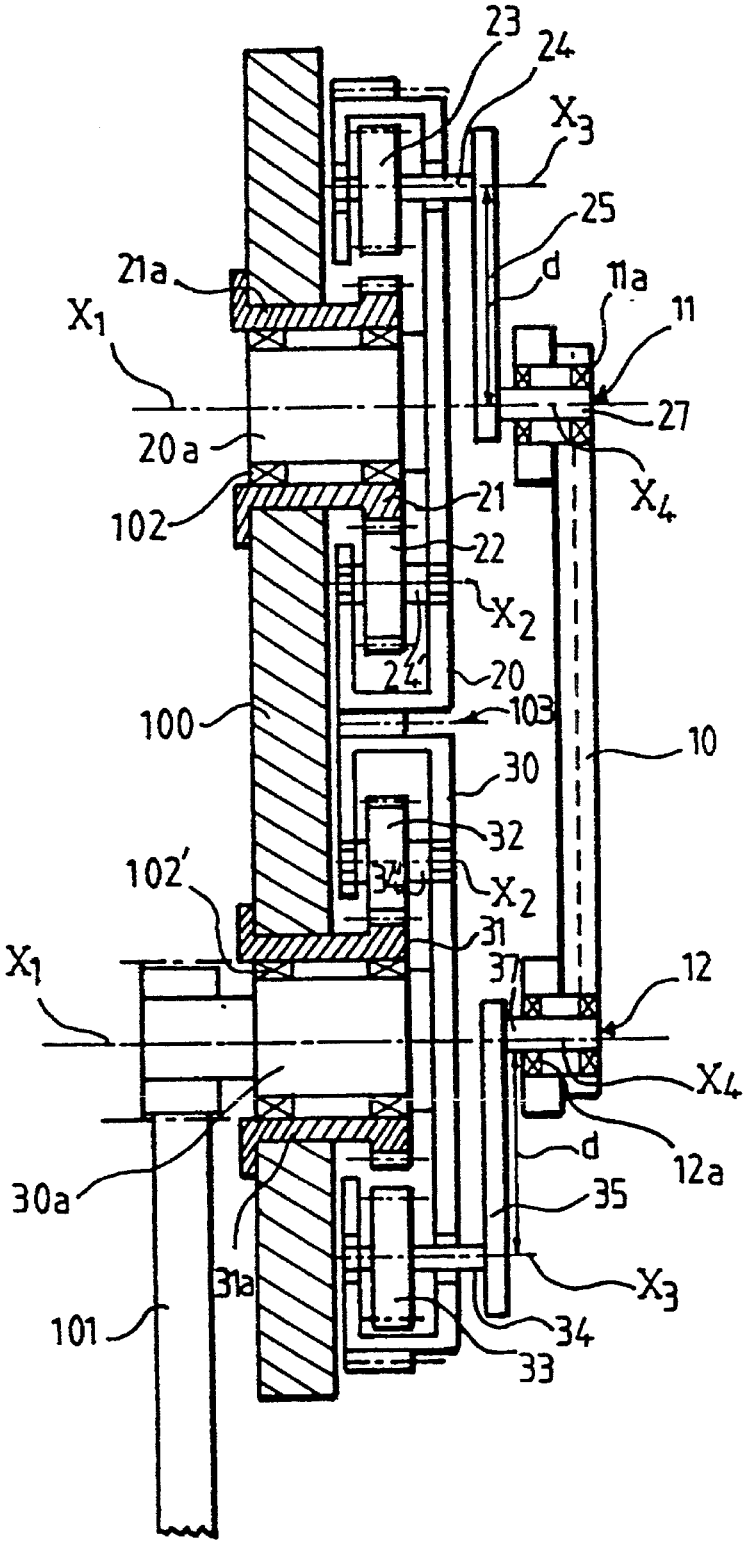
FIG. 1 is a plan view in section along a horizontal plane of an embodiment of the quarter fold folding device according to the invention.
Figure 2:
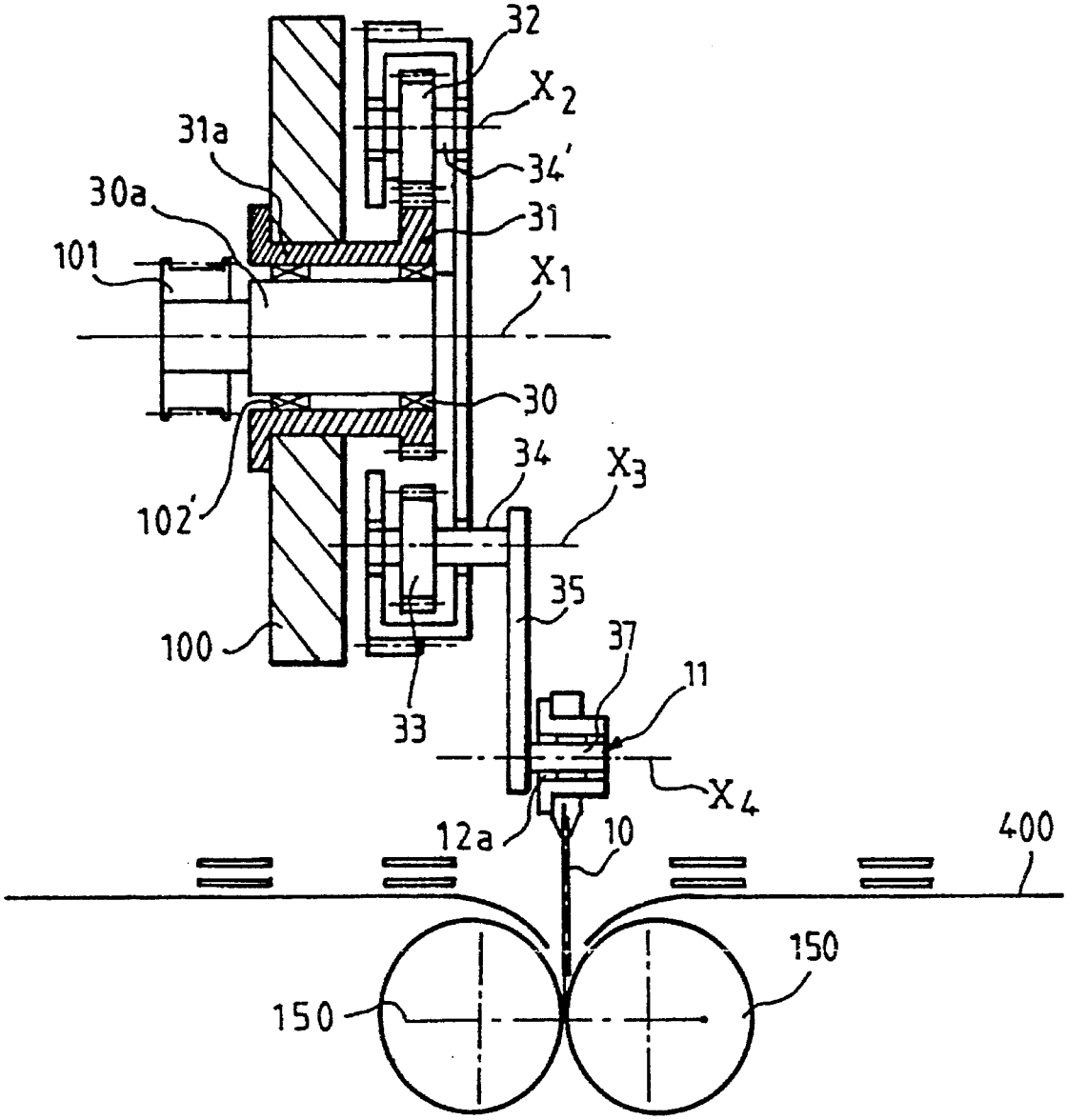
FIG. 2 is a partial side view in section along a vertical plane of the quarter fold folding device according to the invention.

Referring to FIGS. 1 and 2, a quarter fold folding device is shown, which is intended to form, in a signature 400, a longitudinal fold in the direction of forward travel of the signature 400 in a horizontal plane. This device comprises a vertical fixed framework 100 having two horizontal bearings, each situated at the same level, which include roller bearings 102,102' in which two central rotating shafts 20*a*, 30*a* are mounted perpendicularly to the framework 100 and parallel to one another.

One of the two central shafts 30*a* is rotationally driven inside the roller bearing 102' about its longitudinal axis $X_1$ by means of a pulley on which a horizontal belt 101 is wound. This pulley is perpendicularly mounted on the central shaft 30*a* at one of its ends, which is placed outside the framework 100 on the rear side of the device. The belt 101 is also connected to the kinematic chain of the folding machine, not shown, which is itself connected to a motor, also not shown. The second central shaft 20*a* is mounted to rotate freely about its longitudinal axis $X_1$ in its roller bearing 102.

At an opposite end, situated outside the framework 100 on the front side of the device, the horizontal central shaft 30*a*, which is rotationally driven, carries a vertical circular frame 30 at its center. The circular frame 30 has teeth on its peripheral edge which interact in a region 103, situated midway between the two central axes $X_1$, with the peripheral teeth of another vertical circular frame 20 of the same diameter carried at its center by the second freely rotating horizontal central shaft 20*a*. Thus, the circular frame 30, which is rotationally driven by the central shaft 30*a*, itself drives the other circular frame 20 about its central axis of rotation $X_1$, so that the two frames 20,30 revolve at the same speed and in opposite directions.

Furthermore, around each central shaft 20*a*,30*a* a main toothed wheel 21,31 is vertically positioned, and fixed with respect to the framework 100. More particularly, the first fixed main toothed wheel 21 is placed vertically between the framework 100 and the circular frame 20 and is carried by a horizontal sleeve 21*a*. Horizontal sleeve 21*a* is mounted fixedly between the framework 100 and the roller bearing 102, which carries the central shaft 20*a*. Similarly, the second fixed main toothed wheel 31 is placed vertically between the framework 100 and the circular frame 30. Toothed wheel 31 is carried by a horizontal sleeve 31*a*, which is mounted fixedly between the framework 100 and the roller bearing 102', which carries the central shaft 30*a*.

The vertical circular frame 30 supports two horizontal and parallel rotation shafts 34,34' rotationally mounted about their longitudinal axis $X_3$,$X_2$ in roller bearings securely fastened to the frame 30. One of the two shafts 34' carries a vertical intermediate toothed wheel 32, of any diameter, which meshes with the vertical main toothed wheel 31. The other shaft 34 carries a vertical secondary toothed wheel 33, which meshes with the intermediate wheel 32. This secondary wheel 33 has a diameter D1 which is equal to the radius R of the main wheel 31. In an identical fashion, the other circular frame 20 supports two horizontal and parallel rotation shafts 24,24' rotationally mounted in roller bearings about their longitudinal axis $X_3$,$X_2$. These two rotation shafts 24',24, respectively vertically carry an intermediate toothed wheel 22, which meshes with the main toothed wheel 21, and a secondary toothed wheel 23, which meshes with the intermediate wheel 22, and whose diameter D1 is equal to the radius R of the main toothed wheel 21.

The two shafts 24,34 rotate about their axes $X_3$ and carry the two secondary wheels 23,33. The shafts 24,34 also support, at their front ends, which are situated outside the circular frames 20,30 on the front side of the device, two connecting rods 25,35, respectively by each of their ends. These planar connecting rods 25,35 extend in a vertical plane perpendicular to the horizontal shafts and parallel to the vertical plane containing the circular frames and the set of toothed wheels. Each of the connecting rods 25,35 carries, at its opposite end, a horizontal pivot 27,37. The two horizontal pivots 27,37 are mounted to freely rotate in roller bearings 11*a*,12*a*, securely fastened to a quarter fold blade 10.

Figure 3:
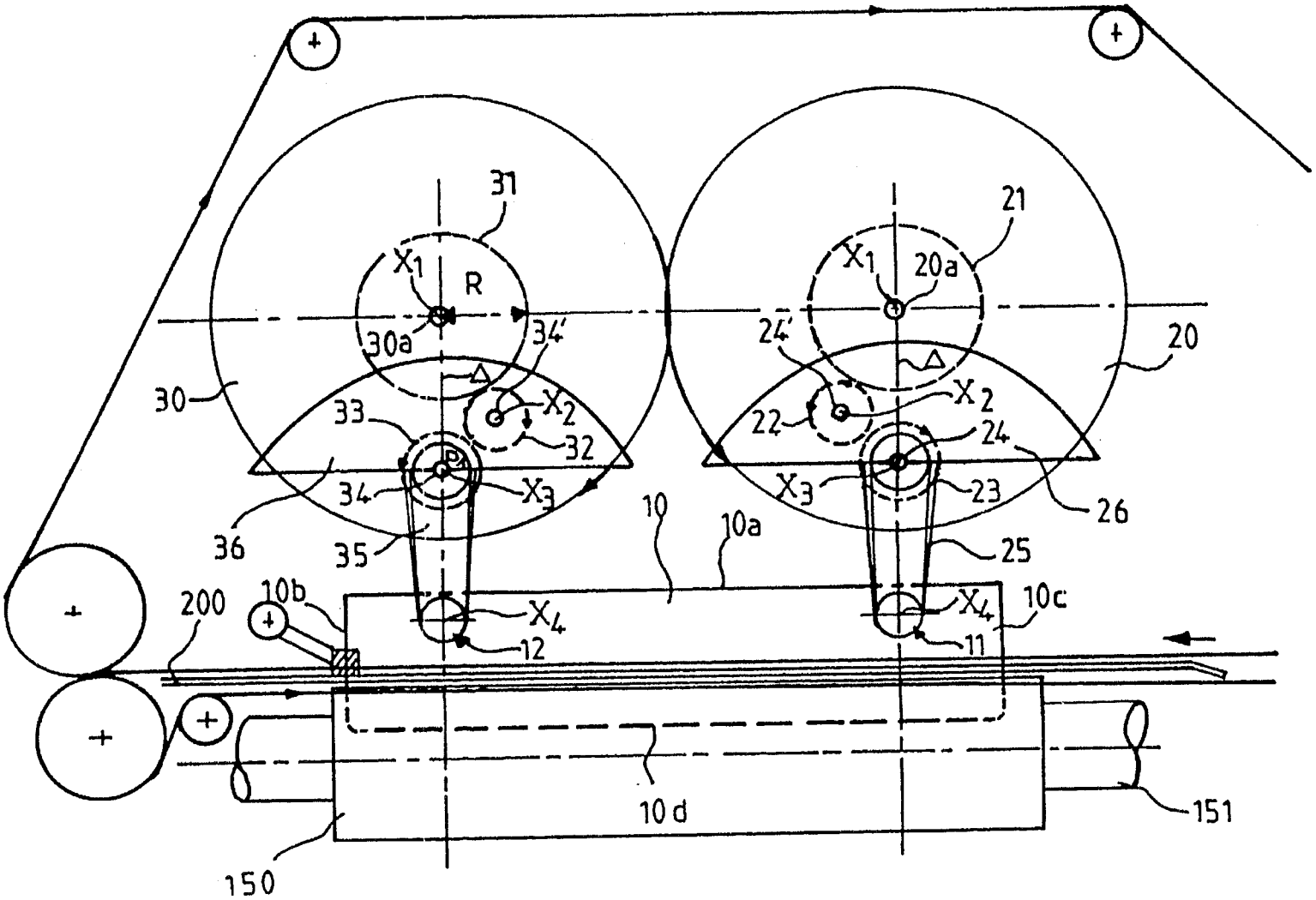
FIG. 3 is a front view of the quarter fold folding device of FIG. 1, the quarter fold blade being in a bottom positions.

As is shown more particularly in FIG. 3, this quarter fold blade 10 is a horizontal blade, which is positioned parallel to the direction of forward travel of the signature 400. Folding blade 10 is positioned just above the signature 400, which is positioned on a folding table 200 having a folding slot that is parallel to the direction of forward travel and faces the quarter fold blade 10. The roller bearings 11*a*,12*a* are supported by the pivots 27,37 and are, respectively, positioned at two opposite ends 11,12 of the quarter fold blade 10. Ends 11,12 of the quarter fold blade 10 are situated just below the upper edge 10*a* of the blade in the vicinity of its vertical free edges 10*b*,10*c*, respectively.

It should be emphasized that the distance d between the axes of rotation $X_3$ of each rotation shaft 24,34 and the axes of rotation $X_4$ of each pivot 27,37 is equal to the distance between the central axes $X_1$ of each central shaft 20*a*,30*a* and the axes of rotation $X_3$ of each shaft 24,34.

Figure 4:
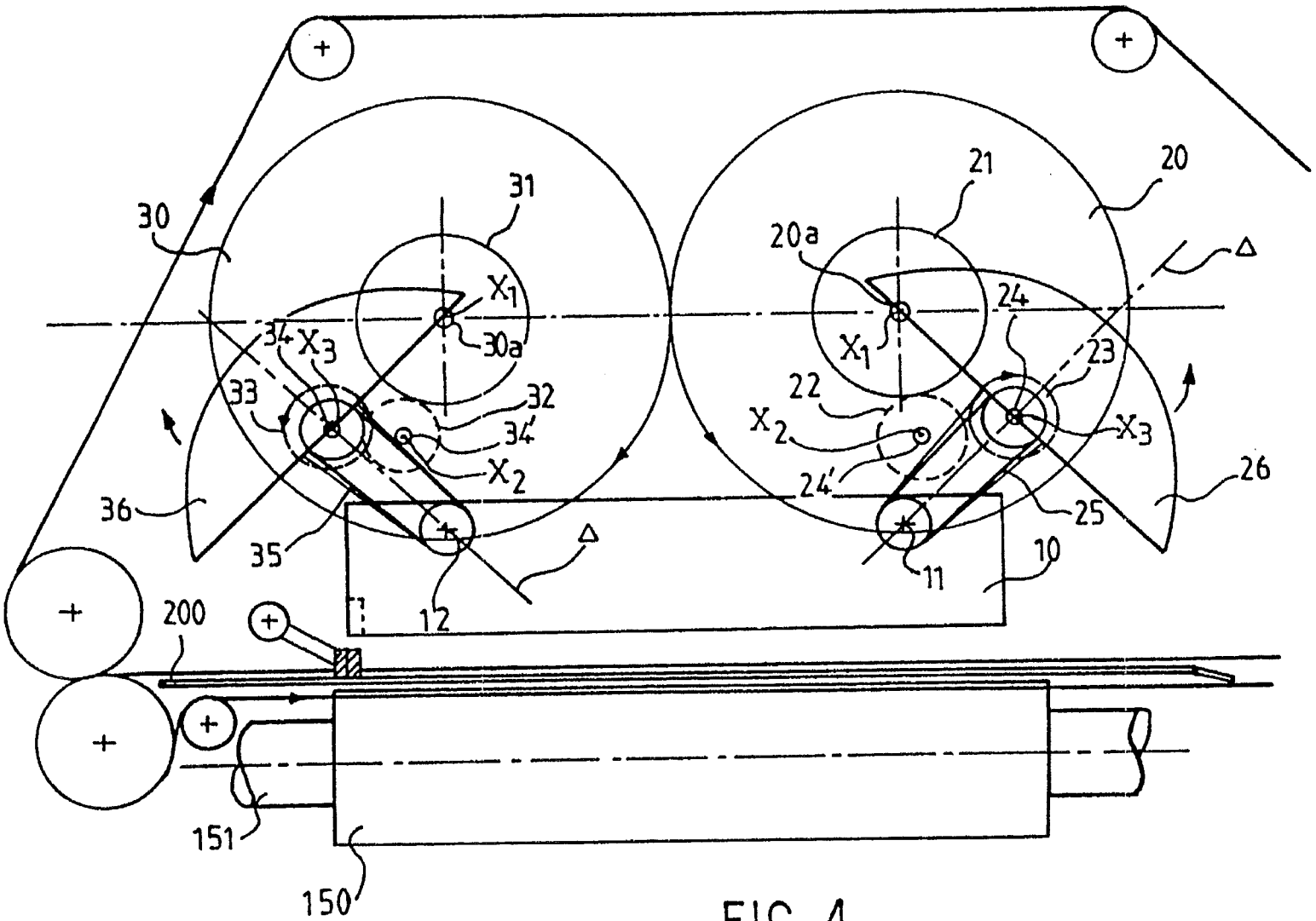
FIG. 4 is a front view of the quarter fold folding device of FIG. 3, the quarter fold blade being in an intermediate position.
Figure 4:
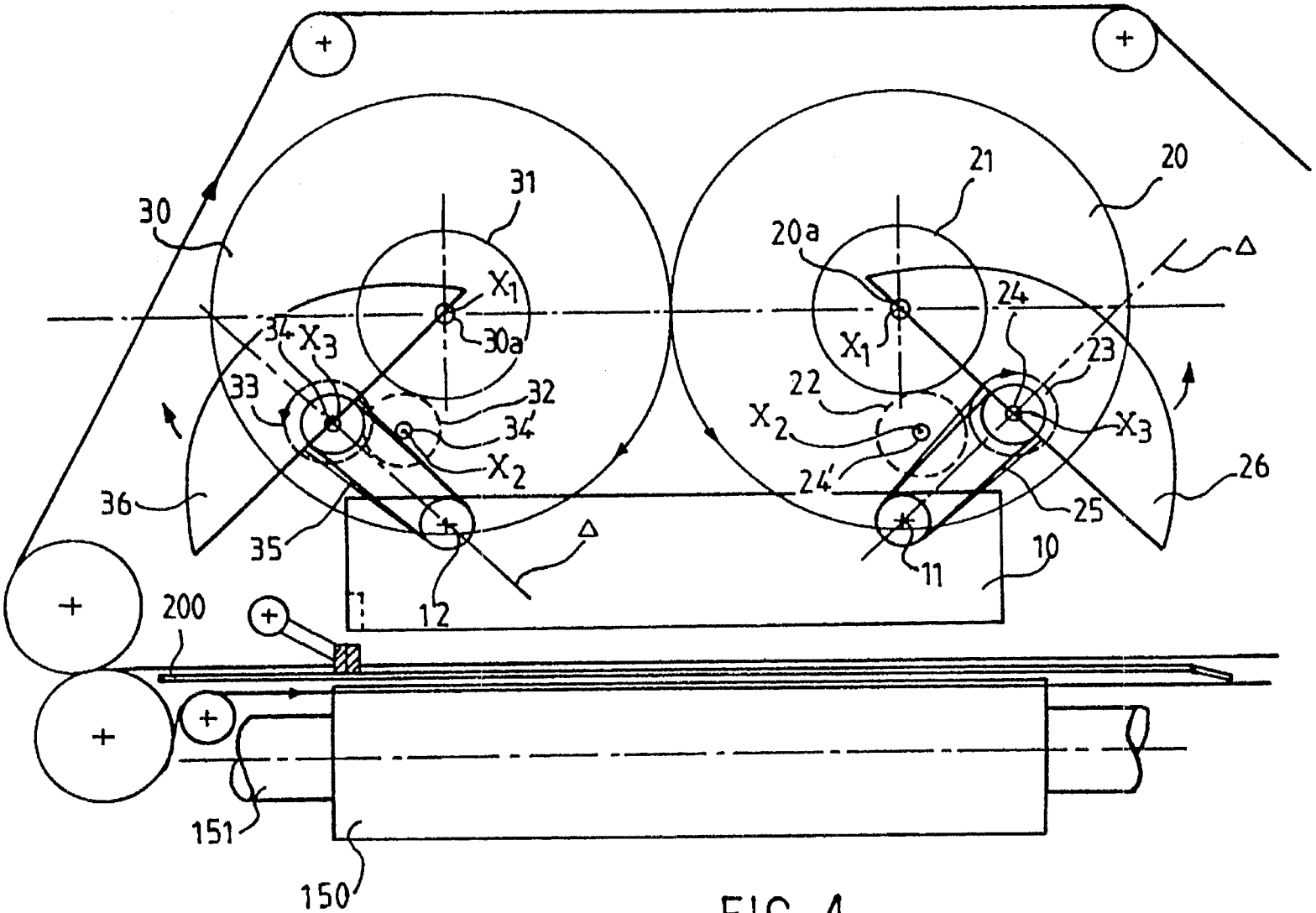

Moreover, as can better be seen in FIGS. 3–5, the two rotation shafts 24,34 carry the secondary toothed wheels 23,33, which support, in the region of their front end, two identical counter weights 26,36, respectively. Counter weights 26,36 are two plane components which have the shape of a segment of a disc symmetrical with respect to a vertical axis of symmetry Δ. Each disc segment is delimited at an upper portion by an arc of a circle and at a base portion by the chord which subtends it. This chord is of greater length than the diameter of the associated secondary wheel 23,33. In particular, each counter weight 26,36 is rotationally mounted on each shaft 24,34 about the longitudinal axes $X_3$, so that each longitudinal axis $X_3$, of each shaft 24,34, is positioned in the region of the base of each counter weight 26,36, perpendicularly on the axis of symmetry Δ. Furthermore, each connecting rod 25,35 extends between the two axes of rotation $X_3$,$X_4$ along the axis of symmetry Δ of each counter weight 26,36.

According to the present invention, not shown, each fly counter 26,36 and the associated connecting rods 25,35 form a single plane component having the general shape of a mushroom, which is symmetrical with respect to the vertical axis of symmetry Δ. Each counter weight 26,36 includes a head delimited at its upper portion by an arc of a circle subtended by a lower edge, and a foot acting as a connecting rod that extends from the lower edge of the head where the axis of rotation $X_3$ is situated, along the vertical axis of symmetry Δ, and as far as the pivot 27,37.

When the quarter fold folding device is operating, the counter weights 26,36 form a system for balancing the dynamic forces generated by the quarter fold blade 10, as will be described more precisely later.

Referring more particularly to FIGS. 3–5, we will now describe, more precisely, the operation of the quarter fold folding device according to the present invention.

The circular frame 30, rotationally driven about the central axis $X_1$ by means of the central shaft 30*a*, meshes with the circular frame 20. Circular frame 20 is mounted on the central shaft 20*a* free to rotate in its roller bearing 102. Thus, the two circular frames 20,30 revolve about the central axes $X_1$ at the same speed and in opposite directions. The movement of these two circular frames 20,30 in opposed rotation, hence drive the two assemblies, each of which includes two rotation shafts 24,34,24',34', respectively, carrying the two toothed wheels 23,33,22,32 in a circular movement about the central axes $X_1$ in opposite directions.

In this way, the intermediate toothed wheels 22,32, carried by the shafts 24',34', which are free to rotate about their longitudinal axes $X_2$, mesh, on the one hand, with the fixed main toothed wheels 21,31, thereby describing, in opposite directions, a circle of diameter 2R about the axes $X_1$ and, on the other hand, with the secondary wheels 23,33, so as to drive the latter and the associated shafts 24,34 in rotation about their longitudinal axes $X_3$ in opposite directions. The shafts 24,34, driven in rotation about the axes $X_3$, thus rotationally drive the connecting rods 25,35 in opposite directions about the longitudinal axes $X_3$ and, simultaneously, in an opposed circular movement about the central axes $X_1$.

When the connecting rods 25,35 simultaneously perform a complete revolution about the central axes $X_1$ and longitudinal axes $X_3$, the ends of the connecting rods 25,35 carrying the pivots 27,37, from which the quarter fold blade 10 is suspended by its opposite ends 11,12, describe parallel vertical segments of a straight line whose length is equal to four times the distance d between the central axis $X_1$ and the associated longitudinal axis $X_3$. Thus, when the circular frames 20,30 perform a complete revolution about the central axes $X_1$, they drive the quarter fold blade 10 in a reciprocating rectilinear vertical movement between a bottom position represented in FIG. 3 and a top position represented in FIG. 5. More particularly, as shown in FIGS. 3–5, when the rotary assemblies perform a half-revolution, the quarter fold blade 10 passes from the bottom position to the top position thereby passing through intermediate positions such as the one represented in FIG. 4. When the quarter fold blade 10 is in the bottom position, it engages the signature 400, via the folding slot between two cylinders 150, which are arranged beneath the folding table 200 parallel to the direction of forward travel and rotationally driven in opposite directions about their axis 151, so as to form the longitudinal fold in the signature 400.

Moreover, due to the fact that the quarter fold blade 10 is suspended from the connecting rods 25,35 in an eccentric manner with respect to the longitudinal axes of rotation $X_3$, it generates, in its vertical movement, vertical dynamic forces over the quarter fold folding device as a whole. The counter weights 26,36 are therefore positioned on the rotation shafts 24,34 so as to eliminate these dynamic forces generated by the moving quarter fold blade. Indeed, since the mass of a half-blade is concentrated on the axis of rotation $X_4$, each system having a connecting rod and a half-blade revolving about each axis $X_3$ has a center of gravity which is closer to the axis $X_4$ than to the axis of rotation $X_3$, which generates an out-of-balance force when the assembly is moving.

In order to re-balance the rotating assembly, each counter weight 26,36 positioned on its respective rotation shaft 24,34 constitutes, with a half-blade and the associated connecting rod, an assembly revolving at the same speed about the axis of rotation $X_3$, the center of gravity of which is situated on the axis of rotation $X_3$. This makes it possible to eliminate any out-of-balance force in a vertical direction during the rotation of this assembly. In addition, in the same manner as the connecting rods, simultaneously with their rotational movement in opposite directions about the longitudinal axes $X_3$, the counter weights 26,36, securely fastened to the rotation shafts 24,34, are driven by the circular frames in a circular movement in opposite directions about the central axes $X_1$. During a complete revolution of the two counter weights 26,36 about the central axes $X_1$, the counter weights pass through a position, not shown, where they are furthest away from one another and a position, also not shown, where they are closest to one another in which the two counter weights 26,36 are tangential to one another with alignment of the two axes of symmetry Δ. Each counter weight 26,36, in its circular movement about the central axes $X_1$, generates dynamic forces in a horizontal direction with respect to the vertical direction of displacement of the folding blade 10. Due to the fact that the fly weights 26,36 revolve in opposite directions, these horizontal dynamic forces compensate for one another, which makes it possible to obtain an overall balanced moving system.

It should be emphasized that the overall movement remains the same when the counter weights 26,36 and the connecting rods 25,35 form a single component. Indeed, each single component revolves about a longitudinal axis $X_3$, simultaneously describing a circle about a central axis $X_1$, and thus drives the quarter fold blade 10 in a vertical movement between the bottom and top positions. Since the shape of the head of each single component remains identical to that of the previously described counter weights 26,36, the assembly constituted by a single component and a half-blade has a center of gravity positioned on the axis of rotation $X_3$, so that the system is balanced.

Of course, the present invention is in no way limited to the embodiment described and represented, but the person skilled in the art will know how to add thereto any variant in accordance with its spirit.

For example, it may be envisaged for the rotary system allowing the quarter fold blade 10 to be displaced vertically suspended from the connecting rods, to be composed of two identical wheels carried at their center by two parallel shafts rotationally driven about their longitudinal axes. These two rotation shafts 24,34 also support the counter weights 26,36 and the connecting rods 25,35 from which the folding blade 10 is suspended. Each wheel has a radius equal to the distance d separating the longitudinal axes of the shafts 24,34 for rotating the wheels and the pivot, which is securely fastened to the connecting rods from which the blade is suspended, so that each anchoring point of the blade on each connecting rod is positioned in the region of the circular edge of each wheel. Furthermore, the shafts for rotating the wheels are respectively simultaneously driven in an opposing circular movement about the center 0 of two fixed identical circles having radii equal to twice the radius of the wheels, so that the wheels run without sliding in opposite directions inside these fixed circles. In this way, when the wheels perform a complete revolution about the centers 0 inside the circles, the anchorage points of the quarter fold blade 10 describe vertical segments of a straight line having a length equal to the diameter of the circles. The counter weights driven by the rotation shafts have opposing rotational movements about the centers 0 and the longitudinal axes of the shafts and allow the system composed of the connecting rods 25,35 and the moving blade 10 to be balanced.

What is claimed is:

1. A device for forming a longitudinal fold in a signature in cooperation with a folding mechanism, comprising:

a folding blade disposed parallel to the direction of forward travel of the signature and above the signature, and having two ends;

a plurality of pivots coupled to the folding blade and free to rotate with respect to the blade;

a plurality of connecting rods, each having a first end and a second end, each first connecting rod end coupled to a pivot;

a plurality of horizontal shafts for rotationally driving the connecting rods, each shaft coupled to the second end of a respective connecting rod, and driven in opposing directions respectively about horizontal central axes, such that when the rotating shafts perform a complete revolution about the central axes, the folding blade is driven between a first position and a second position, the folding blade in the second position engaging the signature in the folding mechanism; and an assembly for balancing dynamic forces generated by the movement of the folding blade, having a plurality of counter weights rotatably coupled respectively to the shafts for counterbalancing the folding blade by revolving in opposing trajectories about the axes of rotation of the shafts and in opposing circular trajectories about the central axes.

2. The device according to claim 1, wherein each counter-weight is formed as a planar component having the shape of a segment of a disc delimited at a first part by an arc of a circle and at a second part opposite the first by a chord which subtends the circle, and having an axis of symmetry perpendicular to the chord, each counter-weight being rotatably coupled to each rotating shaft such that an axis of rotation of each shaft is disposed perpendicularly to the axis of symmetry of each counter-weight in the vicinity of the second part of the counter-weight.

3. The device according to claim 2, wherein the counter-weights, during a complete revolution about the central axes, pass through a first position at which they are furthest away from one another, and a second position at which they are closest to one another with the counter weights tangential to one another and with the axes of symmetry being aligned.

4. The device according to claim 3, wherein each counter-weight and respective connecting rod are formed as a single planar component having the general shape of a mushroom and being symmetrical about the axis of symmetry of the counter-weight, each single planar component having a head delimited at a first edge by a circular arc subtended by a second edge, and a foot formed to act as a connecting rod extending from the head along the axis of symmetry toward the folding blade.

5. The device according to claim 2, wherein each counter-weight and respective connecting rod are formed as a single planar component having the general shape of a mushroom and being symmetrical about the axis of symmetry of the counter-weight, each single planar component having a head delimited at a first edge by a circular arc subtended by a second edge, and a foot formed to act as a connecting rod extending from the head along the axis of symmetry toward the folding blade.

6. The device according to claim 1, wherein each counter-weight and respective connecting rod are formed as a single planar component having the general shape of a mushroom and being symmetrical about the axis of symmetry of the counter-weight, each single planar component having a head delimited at a first edge by a circular arc subtended by a second edge, and a foot formed to act as a connecting rod extending from the head along the axis of symmetry toward the folding blade.

7. A device for forming a longitudinal fold in a signature comprising:

a folding means having two rotating cylinders parallel to a direction of forward travel of the signature;

a folding blade disposed parallel to a direction of forward travel of the signature and above the signature;

two pivots coupled to the folding blade and free to rotate with respect to the blade;

two connecting rods, each having a first end and a second end, each first connecting rod end coupled to a pivot;

two horizontal and parallel shafts for rotationally driving the connecting rods, each shaft coupled to the second end of a respective connecting rod, and driven in opposite directions respectively about two horizontal and parallel central axes, such that when the two rotating shafts perform a complete revolution about the parallel central axes, the ends of the folding blade driven by the connecting rods describe two parallel vertical line segments between a first position and a second position, the folding blade in the second position engaging the signature in the folding means; and an assembly for balancing the dynamic forces generated by the movement of the folding blade having two counter weights rotatably coupled respectively to the shafts for counterbalancing the folding blade by revolving in opposite circular trajectories about the axes of rotation of the shafts and in circular trajectories about the horizontal and parallel central axes.

* * * * *